United States Patent [19]

Reichert

[11] 4,143,573

[45] Mar. 13, 1979

[54] ELECTRICALLY CONDUCTIVE CUTTING BLOCK

[76] Inventor: Leonard K. Reichert, 16 Euston St., Brookline, Mass. 02146

[21] Appl. No.: 861,631

[22] Filed: Dec. 19, 1977

[51] Int. Cl.[2] ..... B26D 7/20

[52] U.S. Cl. ..... 83/658; 83/537; 83/698

[58] Field of Search ..... 83/658, 659, 537, 533, 83/698

[56] References Cited

U.S. PATENT DOCUMENTS

| | | | |
|---|---|---|---|
| 3,166,967 | 1/1965 | Garritt, Jr. | 83/658 |
| 3,167,990 | 2/1965 | Gilmartin | 83/658 |
| 3,517,579 | 6/1970 | Reichert | 83/533 |
| 3,626,800 | 12/1971 | Newton, Jr. et al. | 83/658 |
| 4,036,648 | 7/1977 | Engler et al. | 96/90 R |

FOREIGN PATENT DOCUMENTS

| | | | |
|---|---|---|---|
| 575283 | 4/1933 | Fed. Rep. of Germany | 83/658 |

*Primary Examiner*—Frank T. Yost
*Attorney, Agent, or Firm*—Kenway & Jenney

[57] ABSTRACT

A cutting block or pad having a laminated construction, wherein the adjacent component layers or member elements are mechanically bonded to each other by layers of an electrically conductive adhesive, is disclosed. The block is particularly useful in connection with a clicking die and acts to complete an electrically conductive path as the die first contacts one broad opposing surface of the laminated structure. In a particularly preferred embodiment of the invention, at least one and preferably two electrically conductive rods extend through the interior of the block, normal to the adhesive bonding layers, and each rod is bonded or secured in position by an electrically conductive adhesive material. Each rod thereby makes electrical contact to each adhesive layer, and the electrically conductive rods may also provide mechanical strength to the laminated structure.

21 Claims, 5 Drawing Figures

ELECTRICALLY CONDUCTIVE CUTTING BLOCK

The invention relates in general to cutting blocks for use in a die cutting machine and in particular to cutting blocks which form a portion of an electrical path for die cutting machines.

BACKGROUND OF THE INVENTION

Die cutting machines, commonly known as clickers, are used for cutting blanks of sheet material for example, leather, paper, vinyl, etc. These machines have a stationary cutting block or bed upon which the stock or blank to be cut is spread and a movable striking element or arm by which a sharp edged die, placed on top the blank, is driven by impact through the blank.

As the commercial requirements and specifications (e.g. throughput) for die cutting machines increase, it is increasingly important that the machine be able to accurately sense the instant that the die is driven through the blank and contacts the supporting cutting block beneath the blank. This function is often accomplished by providing an electrically conductive path whereby the die, when it is completely through the blank stock, contacts the cutting block, and thereby completes an electrical circuit which causes the direction of travel of the striking pad to reverse. The cut stock is then removed and a new blank is positioned for cutting.

Several constructions have been used for the supporting cutting block. Most generally, the cutting block or pad comprises a rubber compound impregnated with carbon black to provide electrical conductivity. There have also been attempts lately to achieve electrical conductivity in the cutting block using a polypropylene-type compound, perhaps incorporating carbon black.

The literature also describes a cutting block having a laminated structure comprising a plurality of relatively insulating planar members interleaved with thin electrically conductive foil members. The entire assembly is bonded to form the laminated structure. This construction does not appear to have attained commercial viability, probably because of the relatively high cost of assembling the relatively complex and in part fragile structure. Thus, the thin foil material between insulating members may be prone to tearing and peeling; and the results of using the cutting block in the electrical circuit are unreliable, for example, where the die repetitively contacts the same area of the cutting block.

It is therefore an object of this invention to provide an electrically conductive cutting block which is reliable, which is simple to assemble, and which is low in cost. Other objects of the invention include providing a cutting block which is mechanically and adhesively secure, which can be constructed in any convenient size, which will not peel or rupture, and which can be made of substantially any convenient, suitably resistive and resilient, electrically insulating material.

SUMMARY OF THE INVENTION

A cutting block for providing an electrically conductive path according to the invention features, in one aspect, an integral laminated structure having a plurality of member elements bonded together and having at least one substantially planar broad cutting surface. Each pair of adjacent member elements are bonded to one another at their adjacent surfaces by an electrically conductive adhesive layer. The layer extends over substantially the length and breadth of the adjacent surfaces and forms a substantially continuous layer between the surfaces. The conductive layer has an electrical conductivity substantially greater than the electrical conductivity of the member elements. Thereby, a cutting edge contacting at least the one cutting surface and at least one of the adhesive layers, is in electrical contact with the entire layer.

The cutting block for providing an electrically conductive path according to the invention features, in another aspect, a plurality of planar members, each member having a thickness between planes small compared to its length. The planar members are assembled to form an integral laminated structure. The laminated structure has substantially planar broad opposing surfaces and each pair of adjacent planar members forming said laminated structure are bonded to one another, at their planar surfaces, by an electrically conductive adhesive layer. The adhesive layer extends the entire distance between the opposing surfaces and forms a substantially continuous layer between the opposing surfaces of the laminated structure. The conductive adhesive layers each have an electrical conductivity substantially greater than the electrical conductivity of the planar members. A cutting edge, therefore, contacting one of the opposing surfaces of the laminated structure and in contact with at least one of the adhesive layers is thereby in electrical contact, through at least the one adhesive layer, with a conductive surface in contact with the other opposing surface and lying across and contacting the one adhesive layer.

In a preferred embodiment of the invention, there is further featured at least one and preferably two electrically conductive rods extending through the laminated structure and passing through each of the adhesive layers. Each electrically conductive rod is secured or bonded in position by an electrically conductive adhesive material. The adhesive material is in electrical contact with and forms a continuous electrical path between each of the electrically conductive layers.

DESCRIPTION OF THE DRAWINGS

Other objects, features and advantages of the invention will appear from the following description of a preferred embodiment of the invention taken together with the drawings in which.

DESCRIPTION OF A PREFERRED EMBODIMENT

Figure 1:
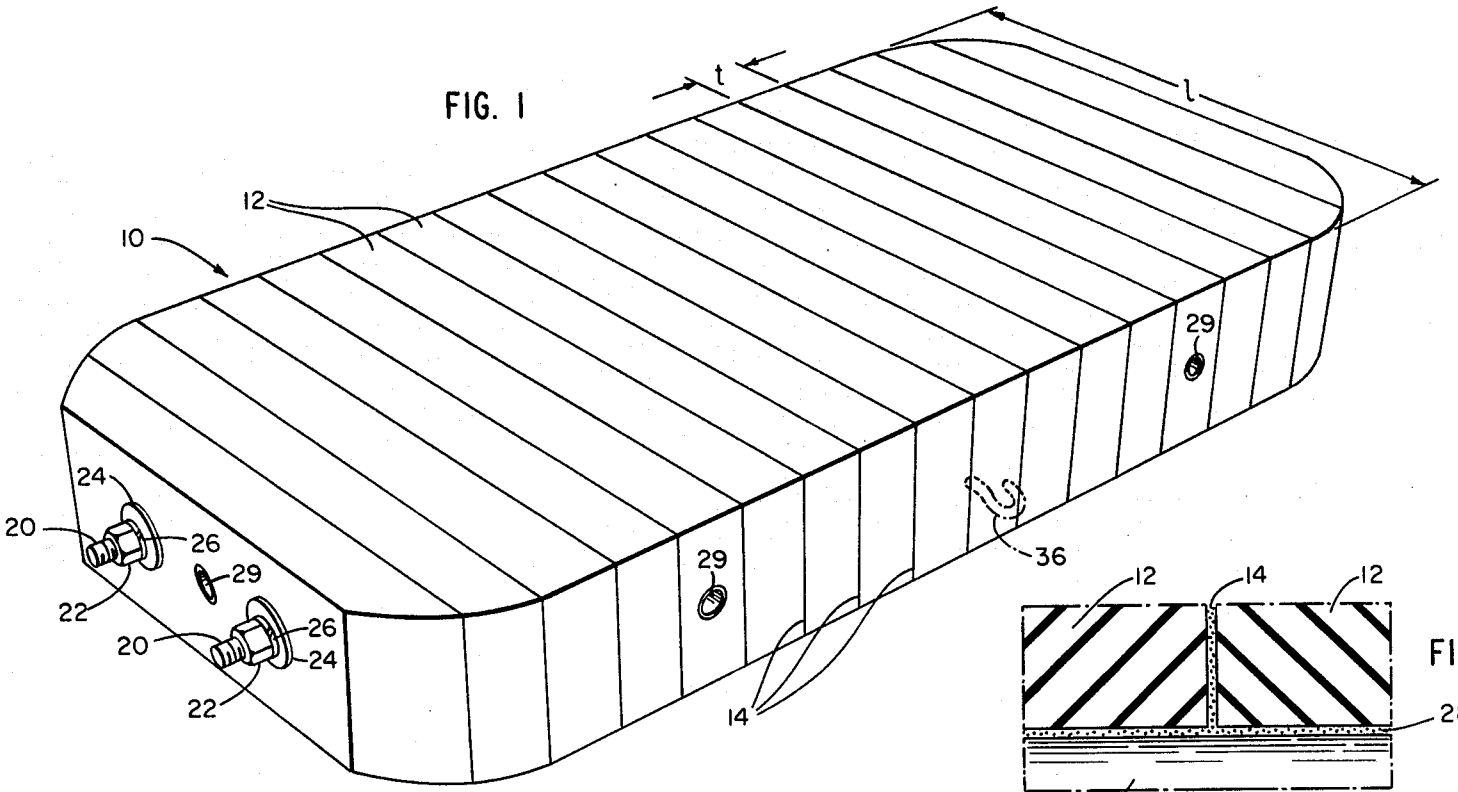
FIG. 1 is a perspective view of a cutting block constructed according to the invention.

Referring to FIG. 1, a cutting block 10 constructed according to the invention comprises a plurality of member elements 12, here planar members, each planar member having a thickness "t" between its plane surfaces small compared to its length "l". The cutting block 10 is a laminated structure in which adjacent member elements 12 are connected or bonded by an electrically conductive adhesive layer 14. Adhesive layers 14 are provided between each pair of adjacent member elements 12 and preferably form a substantially continuous layer between the opposing surfaces 16 and 18 (FIG. 2) of the cutting block 10.

Figure 3:
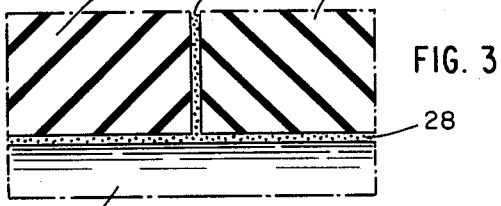
FIG. 3 is a greatly enlarged view showing the electrically conductive layers and taken at the area designated by box 3 of FIG. 2.
Figure 2:
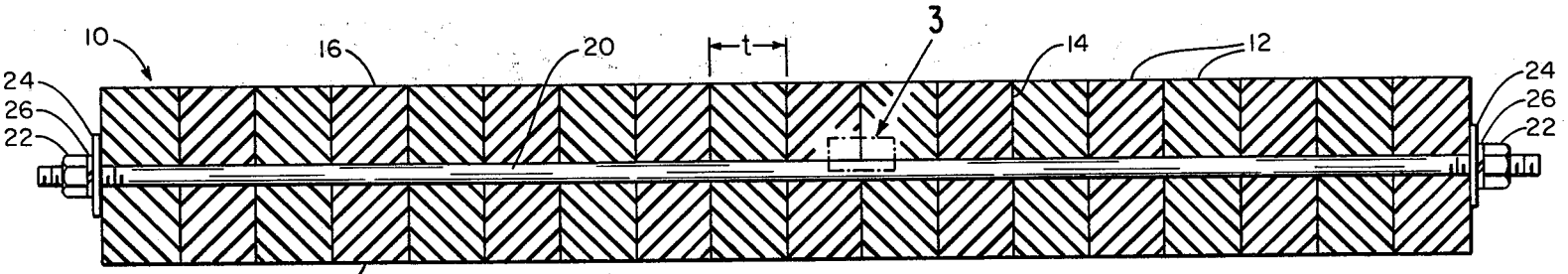
FIG. 2 is a longitudinal cross section of the cutting block taken substantially through one of the electrically conductive rods.

Referring to FIG. 2, the illustrated cutting block 10 preferably includes at least one and preferably two electrically conductive rods 20. The rods may or may not be threaded for their entire length. Each rod 20 extends internally through the laminated structure of cutting block 10 and is preferably secured at either end by nuts 22 and washers 24, 26. Rods 20 are also bonded or secured within the illustrated laminated structure of cutting block 10, by an electrically conductive adhesive material 28 (FIG. 3) which may be and preferably is identical with the material composition of electrically conductive adhesive layers 14. In this preferred embodiment, electrically conductive adhesive material 28 is in electrical contact with at least a portion and preferably all of each of electrically conductive adhesive layers 14 whereby each rod 20 is electrically connected to each of the layers 14 through electrically conducting material 28.

In the illustrated embodiment, a plurality of thimbles 29 (FIG. 1), comprising for example tubular stock press fit into predrilled holes, are spaced around the periphery of the cutting block. The thimbles are operatively engaged by clamping elements (not shown) of the cutting machine, to secure the block in place.

The cutting block according to the invention may be made in any convenient size or shape. In the illustrated embodiment, eighteen 2" thick planar members 12, each having a length, for example, of eighteen inches and a height, for example, of three inches are assembled with a layer of electrically conductive adhesive cement applied to the opposing mating planar surfaces. The adhesive cement bonds the planar members 12 securely together to form the laminated structure having broad, planar opposing surfaces 16, 18, and provides the required electrical path between the opposing surfaces 16, 18 of the block 10. The members 12 may be comprised of any convenient material which is suitable for cutting, such as for example rubber composition, plastic, wood, etc.; however a preferred material is rubber composition. Members 12 will normally be electrically insulating to maintain a low cost structure.

The adhesive cement material forming layers 14 may be any conveniently available material, for example, a conductive epoxy such as Emerson & Cummings Eccobond #57C silver epoxy, or a ureaformaldehyde resin, thermally and electrically set under controlled high pressure conditions. Conductive tape or braid can also be used for layers 14.

Holes are then drilled in the assembled laminated structure for rods 20. The rods 20 are inserted through the drilled holes of the laminated structure and are bonded in place by applying the adhesive material 28 (which may be, and preferably is, the same as adhesive material 14 used between the illustrated planar members) both to the rod surface and in the drilled holes. After the adhesive is set, the rods are bolted at their ends to provide additional mechanical support to the cutting block and to provide an electrical conductor interconnecting all of layers 14 to each other. The nuts 22 and washers 24, 26 may also be bonded using the electrically conductive adhesive.

In a particular embodiment of the invention, rods 20 and thimbles 29 may be made of materials having mechanical properties similar to planar members 12, so that as the cutting block is worn away, the rods and thimbles present cutting properties which will not damage the cutting die, and therefore will provide a longer life and lower effective cost for blocks 10. Thus, for example, the rods may also be made of a rubber composition, plastic, or wood but would also preferably be impregnated with a conductive material so that the rods would be electrically conductive.

In other embodiments of the invention, the predrilled holes may be filled (or pumped) directly with a conductive substance. As an alternative, and to provide additional strength, hollow perforate rods can be used and can be filled, by pumping, with a conductive substance to electrically interconnect the conductive layers 14 and for forming conductive layer 28.

Figure 4:
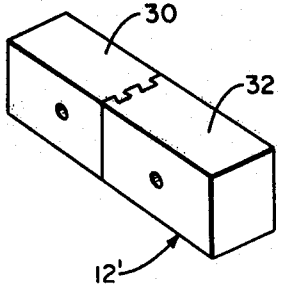
FIG. 4 is a perspective view of an alternate construction for the laminated structure member elements.

Referring to FIG. 4, in another particular embodiment of the invention, the members 12 may themselves be comprised of a plurality of sections 30, 32 which are mechanically interconnected and preferably bonded to form the planar members 12. The mechanical interconnections are well known in the art, for example, they may be the illustrated dovetail connections and a conductive or a nonconductive cement adhesive may be used to further strengthen the sections forming members 12.

Many other methods of construction could also be used to provide the cutting block of FIG. 1. Thus, without significant additional labor cost, a block twice the required height could be assembled and, except for drilling two additional holes for additional rods 20 and inserting and preparing additional rods in these added holes, the labor involved would be substantially identical to that for making a single block of the required height. Once the block is assembled, it would be divided in half to make two blocks, each having the required height.

Similarly, other geometrical shapes for the block could be used. Thus member elements 12 could, for example, be a plurality of annular rings forming a circular cutting block.

Although a cutting block having two opposing broad planar surfaces 16 and 18 is preferred, when conductive rods 20 are used to make electrical connection, internally of the block, to the conductive layers 14, the bottom surface need not be planar so long as it provides the support needed to enable the cutting block to perform its function under the forces applied by the cutting die. When the rods are used, the electrical connection to the block may be made directly to the rod or the thimble 29, or a metallic hook 36 (shown dotted in FIG. 1), could be driven or screwed into a location on the edge of the block between two members 12 and in contact with a layer 14 of adhesive.

While it is preferred that rods 20 be conductive, if the metallic hook or another similar device is used to make the electrical connection to layers 14, the rod may be made of an insulating material. The adhesive material 28 would then be the internal electrically conductive link which interconnects the layers 14.

Figure 5:
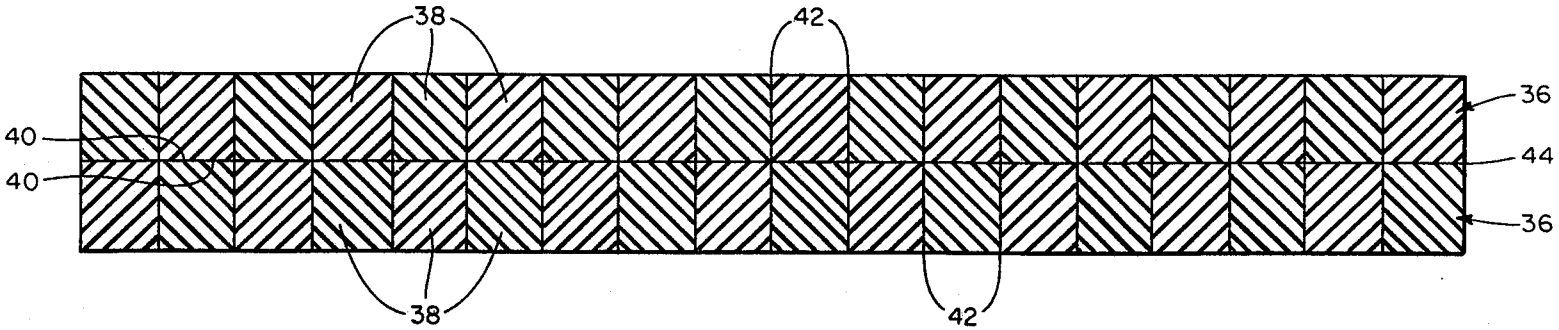
FIG. 5 is a longitudinal cross section of an alternative embodiment of the cutting block according to the invention.

Referring to FIG. 5, in an alternative embodiment of the invention, the cutting block comprises a plurality of laminated substructures 36, each substructure having a plurality of planar member elements 38 connected together and having at least one substantially planar broad bonding surface 40. The planar members of each substructure are bonded together preferably using layers 42 and an electrically conductive adhesive cement. The substructures 36 are then bonded together, at their broad bonding surfaces, by an electrically conductive cement layer 44 which interconnects all of the electrically conductive layers 42. In other embodiments, this "sandwich structure" may have more than the two illustrated layers.

Other embodiments of the invention including additions, subtractions, deletions, and other modifications of the disclosed embodiments will be obvious to those skilled in the art and are within the scope of the following claims.

What is claimed is:

1. A cutting block for providing an electrically conductive path comprising a plurality of planar members, each member having a thickness between planes small compared to its length, said planar members being assembled to form an integral laminated structure, said laminated structure having substantially planar, broad opposing surfaces, and each pair of adjacent planar members being bonded to one another at their planar surfaces by an electrically conductive adhesive layer, said layer extending the entire distance between said opposing surfaces and forming a substantially continuous layer between said surfaces, and said conductive layer having an electrical conductivity substantially greater than the electrical conductivity of said planar members, whereby a cutting edge contacting said opposing surfaces and in contact with at least one of said adhesive layers is in electrical contact, through at least said one layer, with a conductive surface in contact with said other opposing surface and lying across said one layer.

2. The cutting block of claim 1 wherein each planar member is comprised of a plurality of sections mechanically assembled to form the planar member.

3. The cutting block of claim 2 wherein said sections are secured to one another by an adhesive material.

4. The cutting block of claim 1 wherein the conductive adhesive has a resistance to cutting approximately equal to the resistance to cutting of said planar members.

5. The cutting block of claim 1 further including at least one electrically conductive rod extending through said laminated structure and passing through each of said adhesive layers, said electrically conductive rod being secured in position by an electrically conductive adhesive material, said adhesive material being in electrical contact with and forming a continuous electrical path between each of said electrically conductive layers.

6. The cutting block of claim 5 wherein each said rod contacts said adhesive internally of said laminated structure, and each said rod, at its end, has means for mechanically securing the laminated structure together.

7. The cutting block of claim 6 wherein there are two rods, said rods extending substantially parallel to one another, parallel to the opposing surfaces of the laminated structure, and normal to said adhesive layers, each of said rods being electrically connected through said adhesive material to each of said adhesive layers.

8. The cutting block of claim 6 wherein each of said electrically conductive rods, said adhesive material, and said adhesive layers is comprised of a material having a resistance to cutting approximately equal to the resistance to cutting of said planar members.

9. A cutting block for providing an electrically conductive path comprising a plurality of planar members, each member having a thickness between planes small compared to its length, the planar members being assembled to form an integral laminated structure, said laminated structure having substantially planar, parallel, broad opposing faces, each pair of adjacent planar members being bonded to one another at their planar surfaces by an electrically conductive adhesive layer, the adhesive layer extending the entire distance between said opposing surfaces and forming a substantially continuous layer between the surfaces, and said conductive layer having an electrical conductivity substantially greater than the electrical conductivity of the planar members, at least one electrically conductive rod extending through the interior of said laminated structure and passing through each of said adhesive layers, each said electrically conductive rod being bonded to said members by an electrically conductive adhesive material, said adhesive material being in electrical contact with and forming a continuous electrical path between each of said electrically conductive layers, each said rod, at its ends, having means for mechanically securing the laminated structure together, whereby a cutting edge contacting one of the opposing surfaces and in contact with at least one of said adhesive layers is in electrical contact with all of the adhesive layers and with the electrically conductive rods.

10. A cutting block for providing an electrically conductive path comprising a plurality of planar members, each member having a thickness between planes small compared to its length, said planar members being assembled to form an integral laminated structure, said laminated structure having on one side a substantially planar broad cutting surface, each pair of adjacent members being bonded to one another at their planar surfaces by an electrically conductive adhesive layer, said adhesive layer extending the entire length and said breadth of planar surfaces and forming a substantially continuous layer between said surfaces, and said conductive adhesive having an electrical conductivity substantially greater than the electrical conductivity of said planar members, and at least one electrically conductive rod extending through said laminated structure and passing through each of said adhesive layers, said electrically conductive rod being secured in position by an electrically conductive adhesive material, said adhesive material being in electrical contact with and forming a continuous electrical path between each of said electrically conductive layers, whereby a cutting edge contacting said one broad surface and in contact with at least one of said adhesive layers is in electrical contact through said one layer, with all of said layers and said electrically conductive rod.

11. A cutting block for providing an electrically conductive path comprising an integral laminated structure having a plurality of member elements, said laminated structure having at least one substantially planar broad cutting surface, each pair of adjacent member elements being bonded to one another at their adjacent surfaces by an electrically conductive adhesive layer, said adhesive extending over substantially the entire length and breadth of said adjacent surfaces and forming a substantially continuous layer between said surfaces, and said conductive layers having an electrical conductivity substantially greater than the electrical conductivity of said member elements, whereby a cutting edge contacting at least said one cutting surface and in contact with at least one of said adhesive layers is in electrical contact with said entire layer.

12. The cutting block of claim 11 further including at least one rod member extending through said laminated structure and passing through each of said adhesive layers, said rod member being secured in position by an electrically conductive adhesive material, said adhesive material being in electrical contact with and forming a continuous electrical path among the electrically conductive layers.

13. The cutting block of claim 12 wherein said rod member is electrically conductive.

14. The cutting block of claim 11 further including connection means located within the cutting block for electrically interconnecting the electrically conductive layers to form a continuous electrical path among said conductive layers.

15. The cutting block of claim 11 wherein said member elements are assembled to form a plurality of integral laminated substructures each substructure having at least one broad planar bonding surface, and said laminated substructures are joined along the broad planar bonding surfaces by an electrically conductive adhesive layer to form said laminated structure.

16. The cutting block of claim 11 wherein said electrically conductive adhesive layer is an electrically conductive tape.

17. The cutting block of claim 11 wherein said electrically conductive adhesive layer is an electrically conductive braid.

18. The cutting block of claim 11 further including means for electrically connecting each of said conductive layers.

19. The cutting block of claim 11 further comprising a plurality of thimble elements spaced around an outside periphery of said block.

20. The cutting block of claim 19 wherein at least one of said thimbles is in electrical contact with at least one conductive layer.

21. The cutting block of claim 19 wherein each of said thimbles is comprised of a material having a resistance to cutting approximately equal to the resistance to cutting of said planar members.

* * * * *